US007537295B2

(12) United States Patent
Jackson

(10) Patent No.: US 7,537,295 B2
(45) Date of Patent: May 26, 2009

(54) DRAWER UNIT

(75) Inventor: Steven Peter Jackson, Brampton (CA)

(73) Assignee: Gracious Living Corporation, Woodbridge (CA)

( * ) Notice: Subject to any disclaimer, the term of this patent is extended or adjusted under 35 U.S.C. 154(b) by 0 days.

(21) Appl. No.: 11/741,005

(22) Filed: Apr. 27, 2007

(65) Prior Publication Data

US 2007/0257587 A1 Nov. 8, 2007

Related U.S. Application Data

(60) Provisional application No. 60/798,323, filed on May 8, 2006.

(30) Foreign Application Priority Data

May 8, 2006 (CA) ..... 2545978

(51) Int. Cl.
*A47B 88/00* (2006.01)

(52) U.S. Cl. ..... 312/330.1; 312/257.1; 312/351

(58) Field of Classification Search ..... 312/330.1, 312/257.1, 107, 108, 351, 348.4, 258, 334.1, 312/334.7

See application file for complete search history.

(56) References Cited

U.S. PATENT DOCUMENTS 3,462,208 A * 8/1969 Black et al. ..... 312/352
4,501,456 A 2/1985 Schäfer
5,433,518 A 7/1995 Skov
5,839,806 A 11/1998 Liu
5,921,648 A 7/1999 Rong
6,015,053 A 1/2000 Sheng
6,550,880 B2 4/2003 Reuter
2002/0105252 A1 * 8/2002 Dorman ..... 312/257.1
2003/0230957 A1 * 12/2003 Doerfler et al. ..... 312/257.1

* cited by examiner

*Primary Examiner*—James O Hansen

(57) ABSTRACT

A drawer unit has a frame and two or more drawers. The frame may be made in a single piece, for example of injection molded plastic. The drawers may also be of a single piece, for example of injection molded plastic. The frame may be open in a vertical region between the top and bottom of the frame, or between an upper and a lower drawer, in a horizontal region including the bottom of the upper drawer. The frame may also be without horizontal members between the fronts of the drawers. The frame and a drawer may each have a part of a drawer slider mechanism integrated into them. The top and bottom of the frame may be sized and configured such that an upper frame bottom may nest into a lower frame top. A slider mechanism may resist lateral deflection of the side of the frame. The fronts of the drawers may slope upwards to the back of the drawer. The front of the frame may include surfaces backing or obscuring from view angled portions of the drawer fronts.

6 Claims, 13 Drawing Sheets

DRAWER UNIT

This is an application claiming the benefit under 35 USC 119(e) of U.S. Application Ser. No. 60/798,323 filed May 8, 2006. Application Ser. No. 60/798,323 is incorporated herein, in its entirety, by this reference to it.

FIELD

This specification relates to furniture having drawers.

BACKGROUND

A drawer unit, optionally called a chest of drawers, may have a frame, optionally called a carcase, and drawers. The frame may have two sides, a top and bottom, and a back forming five of the six sides of a rectangular prism. Sides may be defined by, for example, a solid surface, a system of horizontal and vertical members, or merely a pair of posts, one or more of which may be shared with an adjacent side. The sixth side, or front, may have a face frame with horizontal cross members spanning between sides of the face frame. Alternately, the front may be defined by the edges of the sides and interior frames or plates spanning between the sides. The cross members of the face frame or the interior frames or plates divide the frame into a series of cavities, each cavity sized to accept a corresponding drawer. The drawers may rest on the cross members, frames or plates, directly or through runners attached to the frame. Alternately, the drawer may be supported on glides, alternately called sliders or other names, which are mechanisms having a pair of matched components, one of the components attached to the drawer, one to the frame.

In plastic drawer units, a frame may be assembled from stacked sub-frames, Each sub-frame may have a horizontal plate or frame and four posts extending upwards from the horizontal frame to a height slightly greater than a corresponding drawer. Several sub-frames may be attached together in a vertical stack with a top placed on the upper sub-frame to form a multi-drawer frame. U.S. Pat. No. 5,839,806 describes an example of such a plastic drawer unit.

SUMMARY

The following summary is intended to introduce the reader to this specification but not to define any invention. One or more inventions may reside in a combination or sub-combination of apparatus elements or process steps described in this summary or in other parts of this document, for example the detailed description or the claims.

When making furniture with drawers, particularly furniture that is to be produced in a factory, it is generally desirable to reduce the number of components and assembly steps for a given product. When working with plastics it is also generally desirable to reduce the mass of plastic in a given product. However, it is also generally desirable for a drawer unit to have a clean appearance and for the drawers to operate conveniently.

This specification describes a drawer unit comprising a one piece frame and two or more drawers. The frame or drawers may be adapted to be injection molded of plastic. The frame or drawer may be molded in a fully formed state in a single mold.

This specification also describes a drawer unit having a frame and two or more drawers. The interior of the frame is open in plan view in an area containing the bottom of a closed drawer and in elevation view between the top and bottom of the frame or between two drawers. The frame may be without horizontal members between vertically adjacent drawer fronts. The depth of a drawer may extend beyond a spacing between vertically spaced drawer slider elements associated with the frame.

This specification also describes a drawer unit comprising a frame and a drawer wherein the frame and drawer each have one part of a drawer slider mechanism integrated into them.

This specification also describes a drawer unit comprising a frame with a top and a bottom. The top and bottom are sized and configured such that, if two drawer units are stacked vertically, the bottom of the frame of an upper drawer unit may be nested into the top of the frame of a lower drawer unit.

This specification also describes a drawer unit having a frame and a drawer. The drawer may slide relative to the frame through a slider mechanism. The slider mechanism may be adapted to resist deflection of the sides of the frame away from the drawer. The resistance may be provided by an interference fit between a portion of the slider mechanism associated with the drawer and a portion of the slider mechanism associated with the frame.

This specification also describes a drawer unit having two or more drawers. The front of the drawers may slope upwards towards the back of the drawer. When closed, the bottom of the front of an upper drawer may protrude forward beyond the top of the front of a lower drawer.

This specification also describes a drawer unit having a frame and a drawer. The front of the drawer may extend horizontally past sides of the drawer to produce an edge of the front of the drawer. In a front view, the edge may have a slope downwards and inwards. In a side view, the edge may slope upwards and towards the back of the drawer. The frame may have a front that provides a vertical surface directly behind the front view slope when viewed from the front. The face may have a vertical surface outside of the drawer edges that covers the side view slope when viewed from the side. The drawer may be injection molded of plastic and the slopes may correspond to draft angles of a mold used to produce the drawers.

This specification also describes a drawer unit comprising a one piece injection molded plastic frame and two or more drawers.

This specification also describes a drawer unit comprising a frame and a drawer; the frame comprising a top, a bottom, and a pair of sides; the drawer comprising a drawer bottom, wherein the frame is open in a region which in plan view includes the area of the drawer bottom and in elevation view extends between two vertically adjacent drawers. The drawer unit may have a second drawer wherein the second drawer is upper and may abut the lower drawer. The bottom of the upper drawer may abut against the top edge of the front of the lower drawer.

This specification also describes a drawer unit comprising a frame and a drawer wherein the sides of the frames have two or more vertically spaced horizontally extending runners and the drawers have sides, the drawer sides having horizontally extending ridges, wherein the runners of the sides and ridges of the drawers are configured to slide together such that a portion of the runner is interior to a portion of the ridge so as to provide a laterally interfering fit. The sides of the drawer may have a vertical depth greater than the vertical spacing between the runners. The runners and ridges may have a vertically interfering fit. The runners may comprise a surface above the ridges. The surface above the ridges may be generally continuous along the length of the runner. The runners may comprise a surface below the ridges. The surface below the ridges may comprise a portion near the front of the frame which abuts against the ridge. The runners may have detents. A detent of the back of the drawer may abut a horizontal portion of the runner.

This specification also describes a drawer unit comprising a frame, the frame further comprising a top and a bottom, the top having a raised lip, the inside of the raised lip being outside the plan view periphery of the bottom. The raised lip may surround the perimeter of the top.

This specification also describes a drawer unit comprising a frame and a drawer wherein the drawer has a front sloping upwards towards the back of the drawer.

This specification also describes a drawer unit comprising a frame and a drawer wherein a part of the drawer has edges extending beyond the sides of the drawer and backs of the edges slope upwards towards the back of the drawer. The drawer may be injection molded. The frame may have sides and the frame sides may have front edges that overlap the edges of the drawer at least as far as the back of the bottom of the drawer edges.

This specification also describes a drawer unit comprising a frame and two or more drawers wherein the frame is free of horizontal members between the fronts of vertically adjacent drawers.

This specification also describes the ornamental design of a frame, drawer or drawer unit as shown in the Figures.

This specification also describes various further combinations of two or more of the aspects or sets of features discussed above and various additional features. An embodiment will be described below having the aspects discussed above as well as various additional features.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors and owners reserve all rights in any invention disclosed in an apparatus or process described below that is not claimed in this document, for example the right to claim such an invention in a continuing application, and do not abandon, disclaim or dedicate to the public any such invention by its disclosure in this document.

Figure 1:
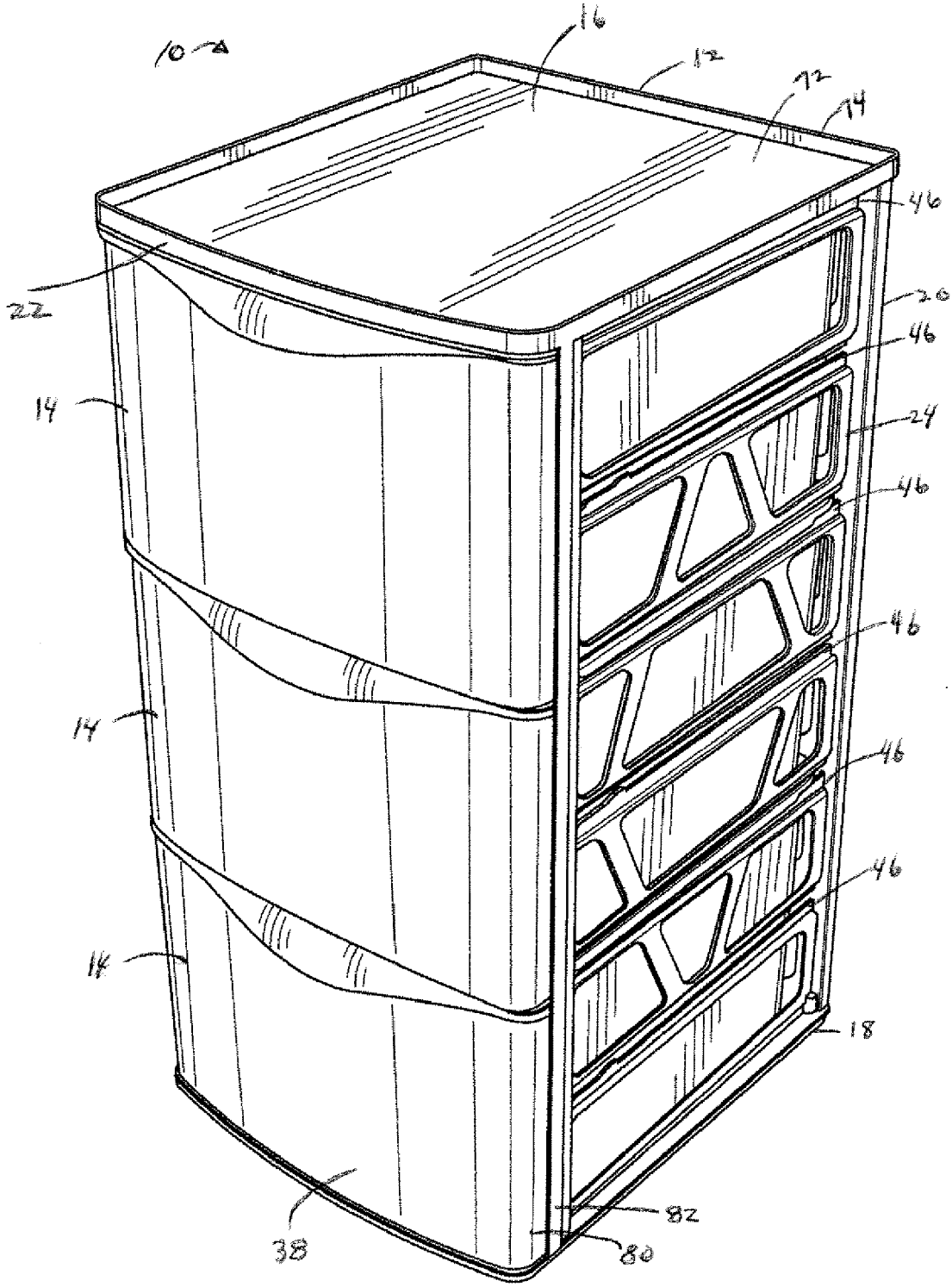
FIG. 1 is an isometric view of a drawer unit showing the front, right side and top.

FIG. 1 shows a drawer unit 10 having a frame 12 and a drawer 14. The drawer unit 10 may have one or more drawers, for example between 2 and 6, or three as shown. The frame 12 is adapted to be injection molded of plastic in a single piece in the form shown. Each drawer 14 is also adapted to be injection molded of plastic in a single piece. Alternately, a frame or drawer may be made of other materials, in multiple pieces or in a single or multiple piece knock down form that may be folded or assembled into the standing configuration shown in FIG. 1.

Figure 6:
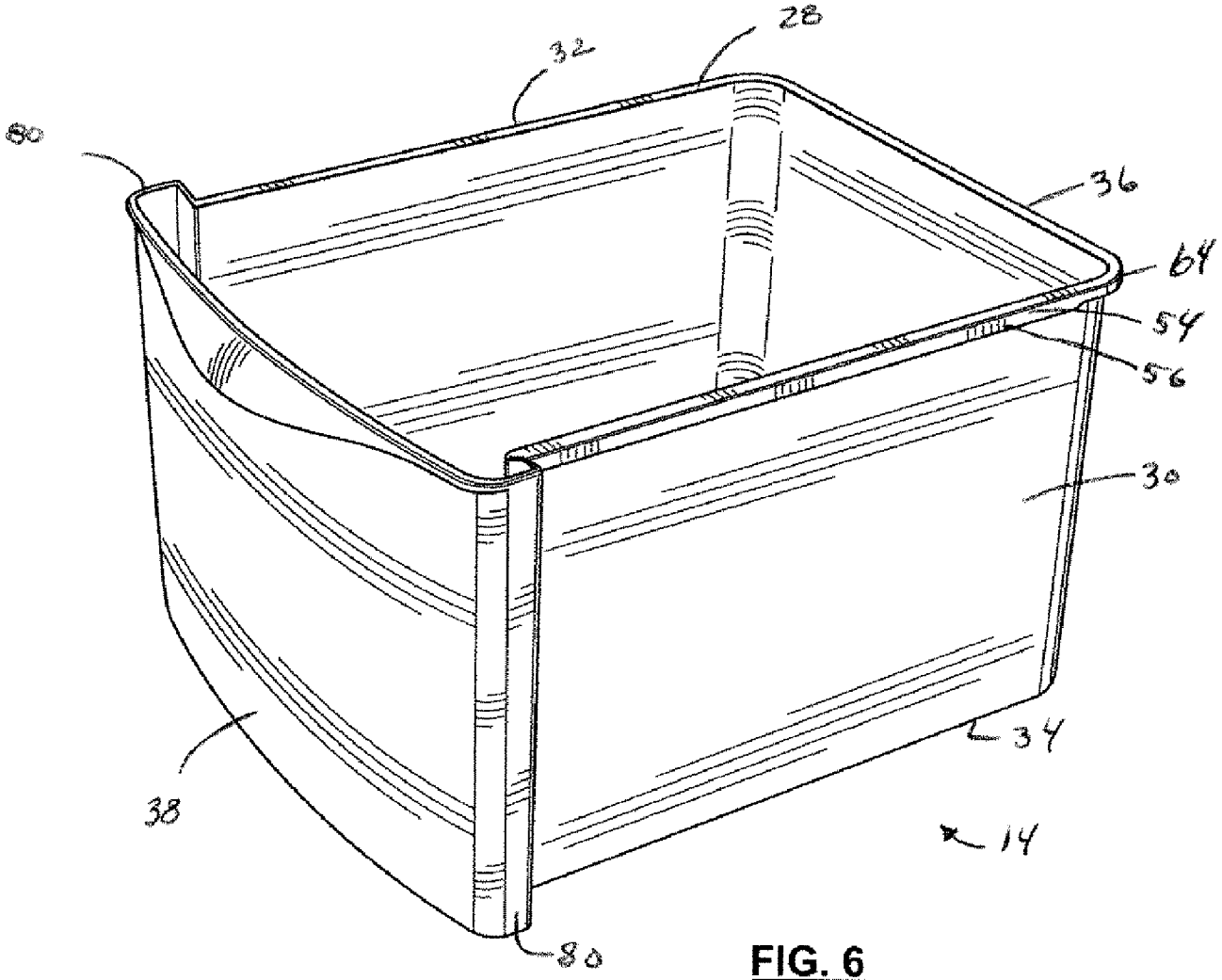
FIG. 6 is an isometric view of a drawer of the drawer unit of FIG. 1 showing the front, top and right side of the drawer.
Figure 7A:
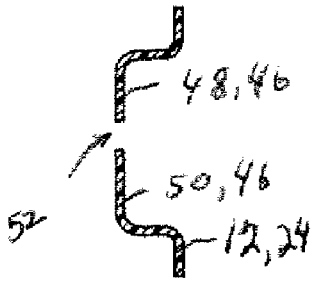
FIGS. 7A, 7B and 7C are cross sections of parts of the drawer unit of FIG. 1 along the section lines shown in FIG. 5.
Figure 7B:
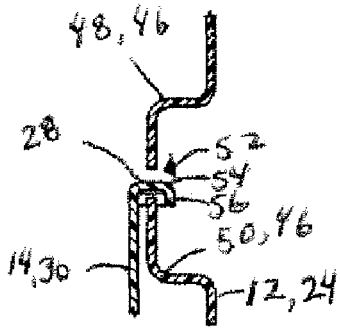
Figure 7C:
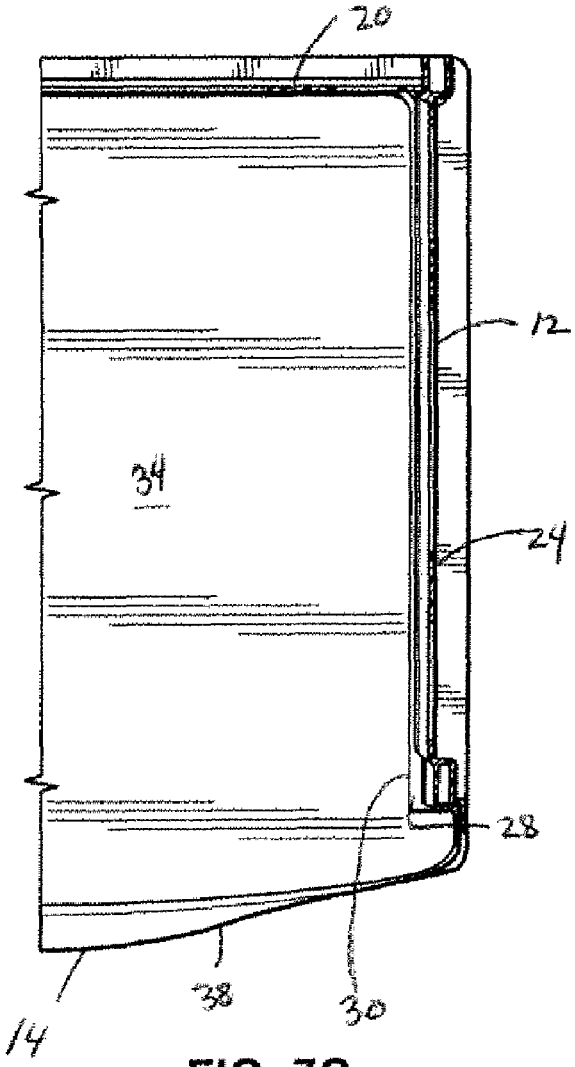

The frame 10 has a top 16, bottom 18, back 20, front 22, left side 24 and a right side 26. The right side 26 visible in FIG. 8B and is generally a mirror image of the left side 24. Referring to FIG. 6, a drawer 14 has a top 28, left side 30, right side 32, bottom 34, back 36 and front 38.

Referring to FIGS. 5, 7C, 8B and 8C, the front 22 of the frame 12 defines an entrance or opening 40 sized and configured to accept a drawer 14, or multiple drawers 14 or all of the drawers 14 of the drawer unit 10. To accept a drawer 14, the opening 40 admits at least a major portion of the drawer 14 behind the front 38 of the drawer 14. The front 22 of the frame 12 or the opening 40 may be without horizontal cross members spanning across the sides 24, 26 of the frame 12 between a vertically adjacent pair of drawers 14 or between all vertically adjacent pairs of drawers 14. The frame 12 may be open in plan view area between a pair of vertically adjacent drawers 14 or between all pairs of vertically adjacent drawers 14. In this way, a drawer 14 may be replaced by a deeper drawer, for example deep drawer 44 or double drawer 42 shown in FIGS. 9B and 9C, without interference between the deeper drawer and the frame 12.

Referring, for example, to FIGS. 5, 7A, 7B and 7C, the sides 24, 26 of the frame 12 have runners 46. The runners 46 protrude inwards from the sides 24, 26 and extend generally horizontally across most of the width of the sides 24, 26. The runners 46 may have an upper part 48 and a lower part 50 which define an open fronted slot 52. Referring to FIG. 1, the sides 24, 26 may have multiple vertically spaced runners 46. The spacing between adjacent runners 46 may be generally constant as shown, or according to some other form of division, or irregular. An uppermost runner 46 may incorporate the top 16 of the frame in place of an upper part 48. The runners 46 may be integral with, for example molded as a part of the sides 24, 26 of the frame 12, or may be separate components attached to the sides 24, 26.

The tops 28 of a drawer 14 may have ridges 54 extending horizontally across most of the length of the sides 30, 32 of the drawer 14. The ridges 54 of a drawer 14 may slide into, out of or along a portion of the length of the runners 46. When the ridges 54 of a drawer 14 are at least partially within the slot 52 of a runner 44 a portion of the runner 46 is located between an outer wall portion 56 of the ridge 54 of the drawer 14 and the side 30, 32 of the drawer 14. This provides a laterally interfering fit between the ridge 54 and the runner 46. In this way, the drawer 14 prevents the sides 24, 26 of the frame from moving away from each other beyond a permitted range of movement. This in turn inhibits slender column buckling of the sides 24, 26 of the frame 12 and so allows for a comparatively lighter structure of the sides 24, 26, or the reduction or elimination of horizontal cross members between the sides 24, 26.

Figure 9C:
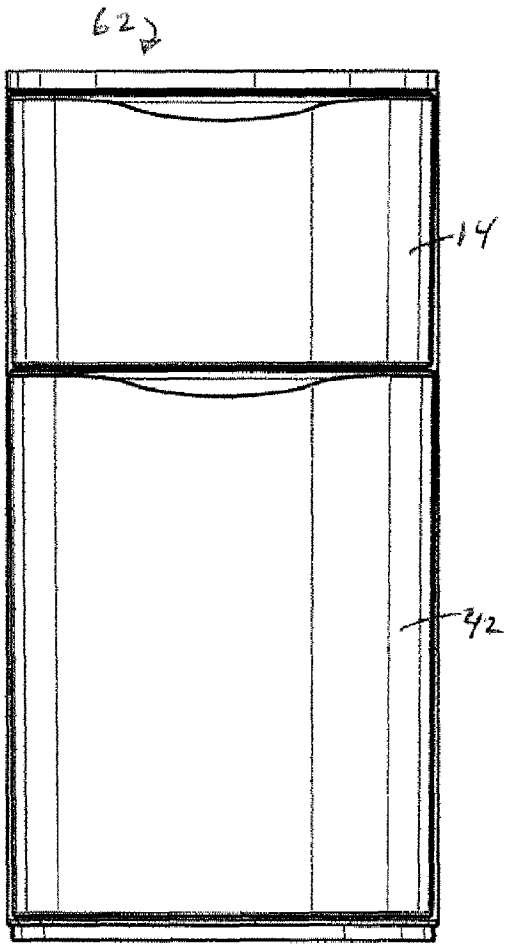
FIGS. 9A, 9B and 9C are front views of the drawer unit of FIG. 1 with alternate drawer sets.
Figure 9B:
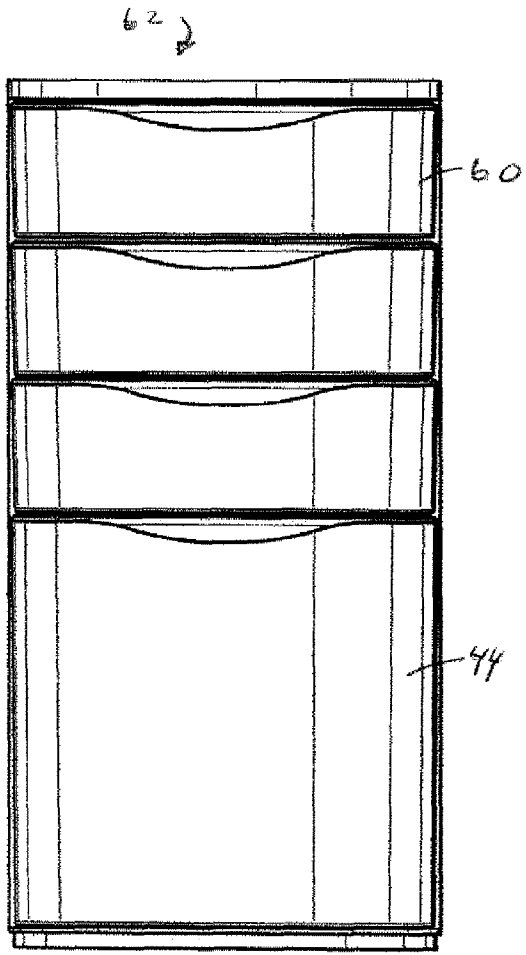
Figure 9A:
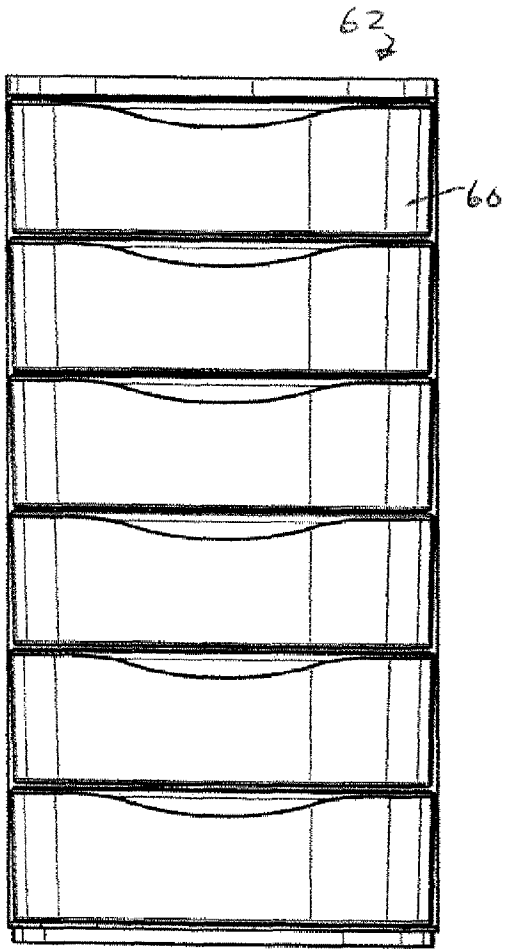

Runners 46 may be provided at vertical locations part way, for example half way, between the top 28 and bottom 34 of the drawer 12. In this way, as shown in FIGS. 9A and 9B, a shorter drawer 60 may be used in place of a drawer 14 and another drawer added below the shorter drawer 60. For example, two shorter drawers 60 may fill the space of one drawer 14. In the drawer unit 10 shown, each side 24, 26 has six equally spaced runners 46 and may be outfitted with drawers 14, 42, 44, 60 corresponding to a multiple, for example one, two, three or four of the spaces between adjacent runners 46. This allows the alternate drawer units 62 of FIG. 9A, 9B, or 9C to be made. Other alternate drawer units may also be made. For example, in FIG. 9A, any one or two adjacent pairs of shorter drawers 60 may be replaced by a drawer 14. For further example, in FIG. 9B, any adjacent pair of shorter drawers 60 may be replaced by a drawer 14 or all three shorter drawers 60 may be replaced by a deep drawer 44. For further example, in FIG. 9C, the drawer 14 may be replaced by a pair of shorter drawers 60. Alternate drawers 42, 44, 46 may be similar to drawer 14 in all respects other than their depth.

Figure 4:
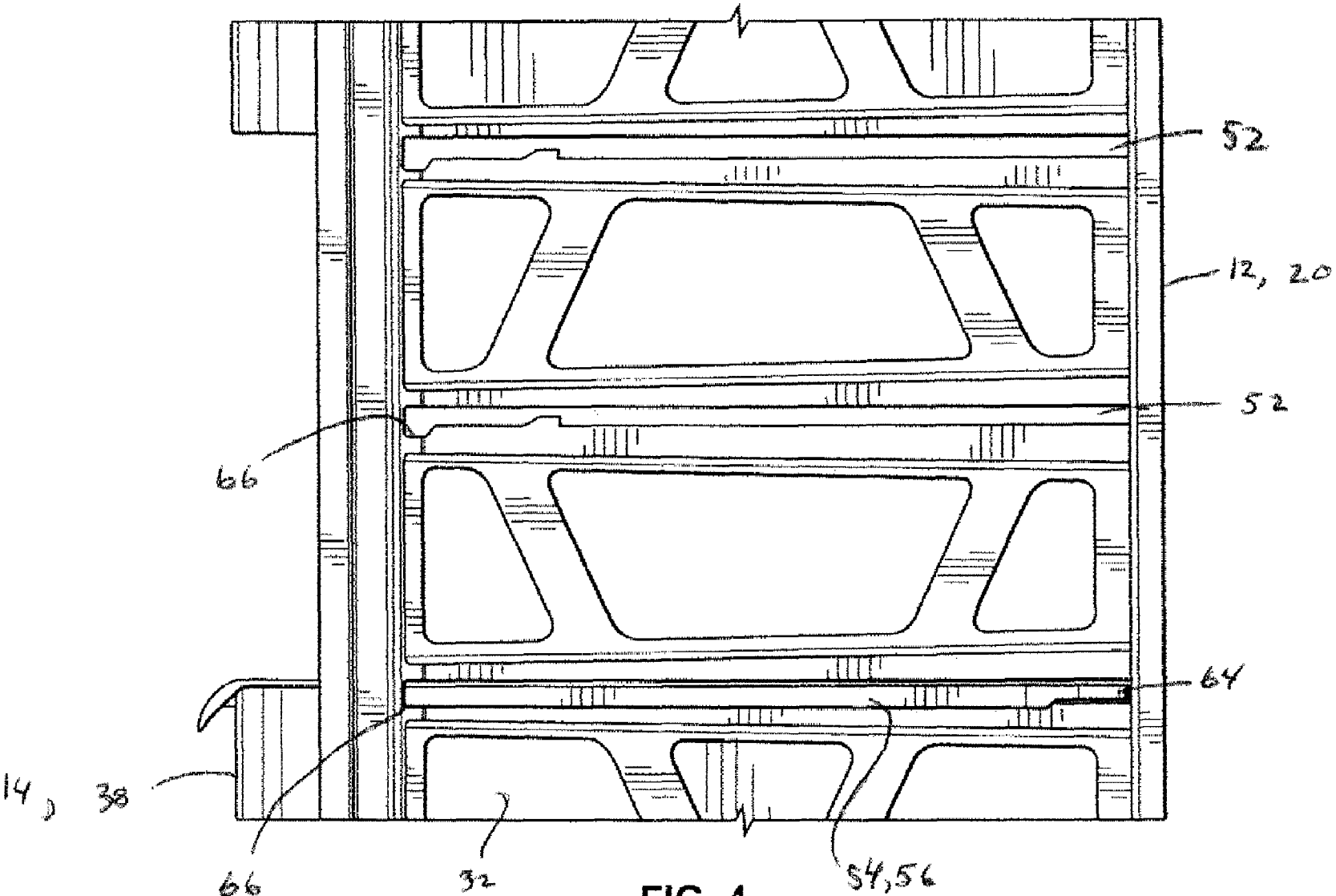
FIG. 4 is an elevation view of a part of the right side of the drawer unit of FIG. 1 with a drawer removed.
Figure 5:
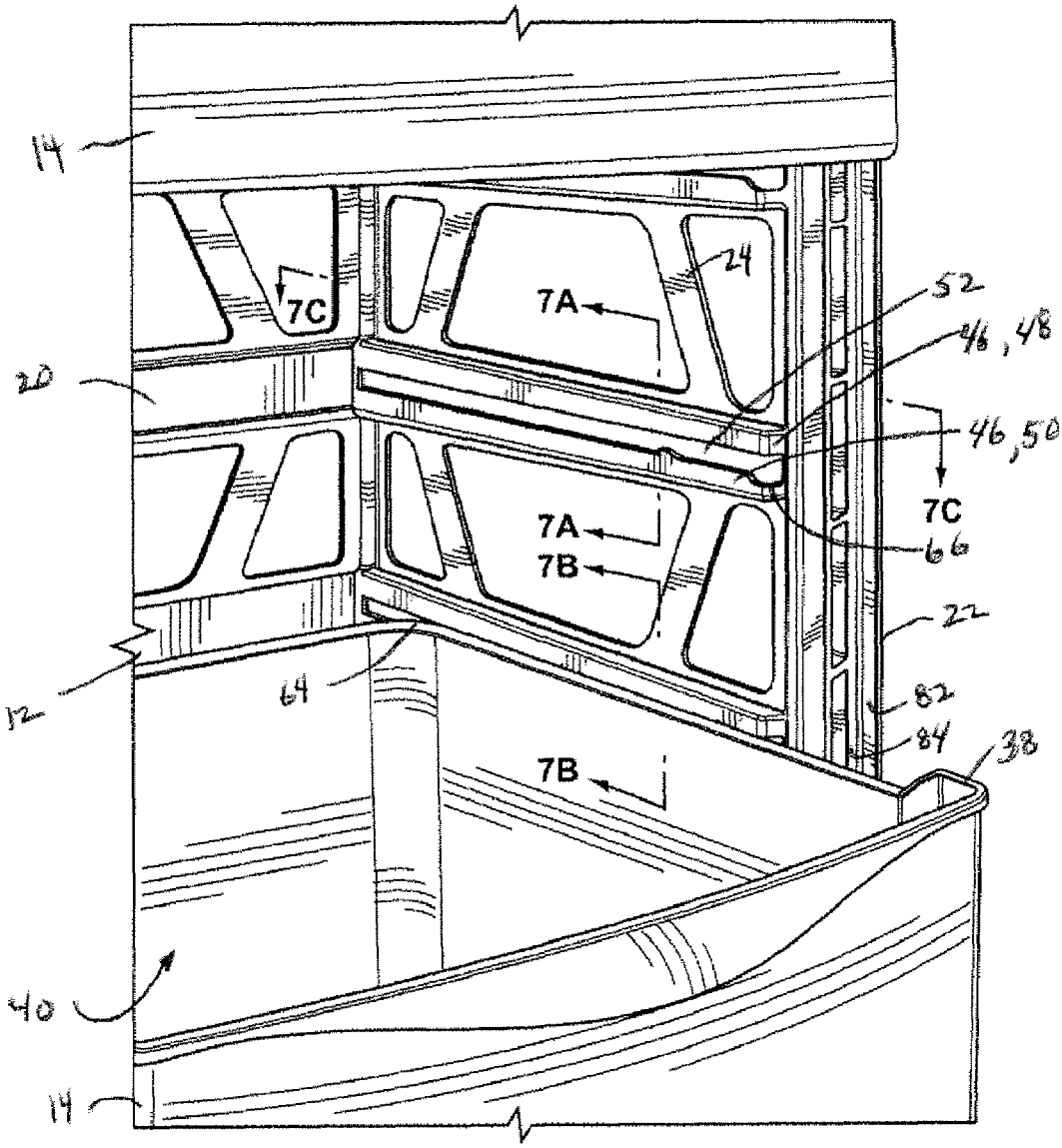
FIG. 5 is an isometric view of a part of the drawer unit of FIG. 1 with an upper drawer removed and a lower drawer partly open and showing the inside of the back and right side of the drawer unit.

Referring, for example, to FIGS. 4 and 6, the ridges 54 of the drawers 14 may also have a vertically interfering fit with runners 46. To support the weight of the drawer, a rear corner 64 of the ridge may be shallower than the wall portion 56 of the ridges 54. The rear corner 64 of the ridge 54 is narrower than the slot 52 to allow the drawer 14 to be slid into the slot 52. The rear corner 64 can abut on or bear against the lower part 50 of the runner to help transfer the weight of the drawer 14 to the frame 12. Further, the front of the lower part 50 may have a notch 66 which provides clearance for the outer wall portion 56 when the ridge 54 is slid into the slot 52. The upper surface of this notch 66 may bear against the bottom surface of the wall portion 56 of the ridge 54 to help transfer load from the drawer 14 to the frame 12. When a drawer 14 is fully closed, as shown for example in FIG. 2, or partially closed to a degree in which most of the weight of the drawer and its contents are behind the notch 66, the weight of the drawer 14 and its contents are essentially carried by the two pairs of abutting surfaces described above.

Figure 3A:
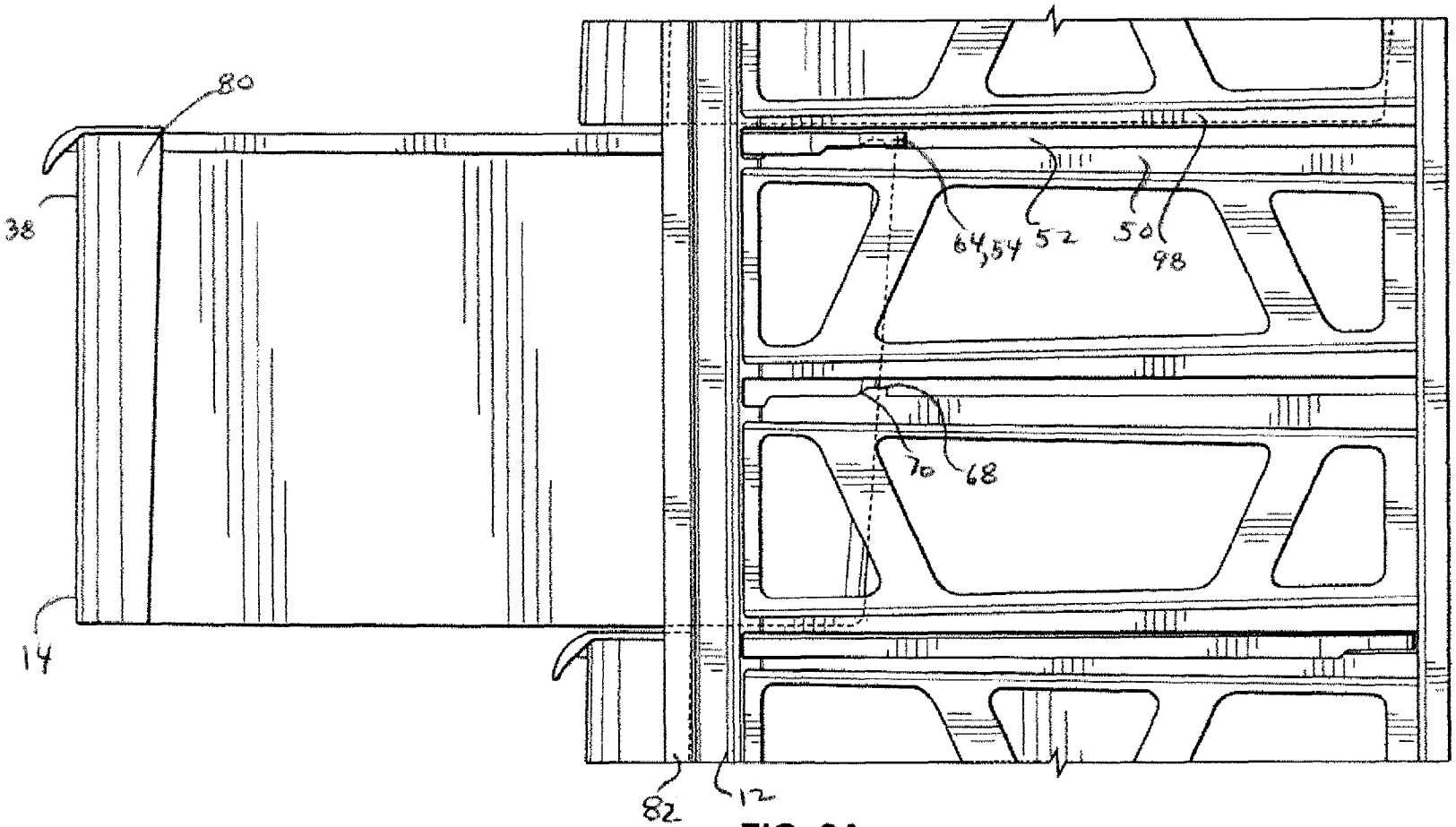
FIG. 3A is an elevation view of a part of the right side of the drawer unit of FIG. 1 with a fully open drawer.

To help prevent a person from inadvertently pulling a drawer 14 too far out of the frame 12, the runners 46 may have a detent 68 which protrudes upwards from the lower part 50 of the runner 46 into the slot 52. As shown in FIG. 3A, when a person pulls a drawer 14 open, but supports the front 38 of the drawer, the inside of the rear corner 64 of the ridge 54 will abut against detent 68 at a forward position of the drawer 14. However, if the person lowers the front of drawer 14, the rear corner 64 of ridge 54 may be pivoted upwards to clear detent 68 and allow the drawer 14 to be removed because the thickness of rear corner 64 is less than the distance between the top of detent 68 and the bottom of upper part 48 of runner 46. On installation of a drawer 14, a sloped front 70 of the detent 68 lifts the rear corner 64 of the ridge 54 as it passes by the detent 68.

Figure 3B:
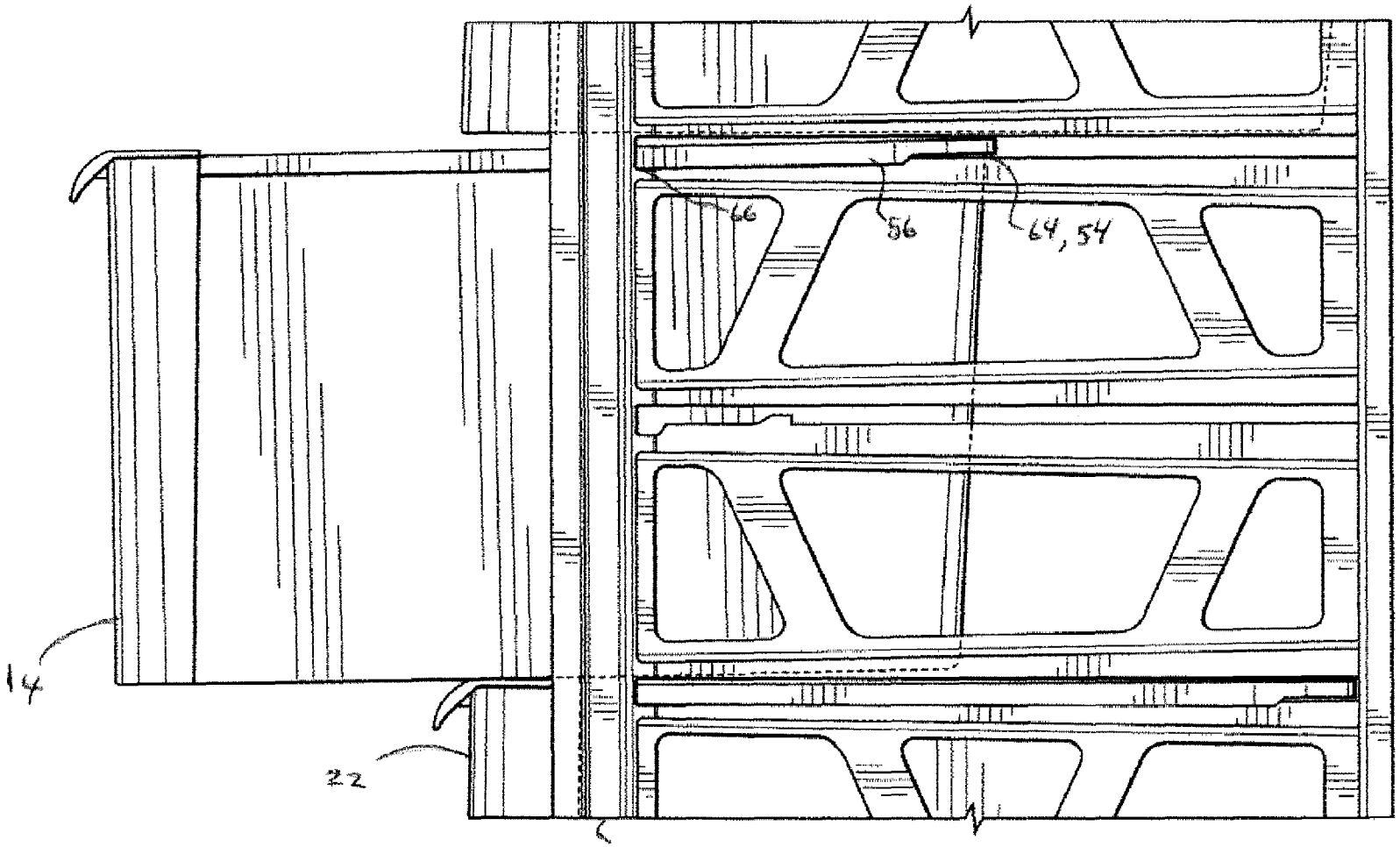
FIG. 3B is an elevation view of a part of the right side of the drawer unit of FIG. 1 with a partially opened drawer.

Referring to FIG. 3B, when a drawer 14 is opened to a point where most of the weight of the drawer 14 is in front of notch 66, the drawer 14 may tip downward. In this case, the top of the rear corner 64 may abut against and bear on a lower surface of the upper part 48 of runner 46. For the uppermost drawer 14, rear corner 64 may bear on the top 16 of the frame. Alternately or additionally, the back 36 of a drawer 14 may bear on the bottom 34 of an upper drawer 14. In a position as shown in FIG. 3B, the drawer 14 may continue to be supported by notch 66, or may be supported by the top of the front 32 of a lower drawer or the bottom 18 of the frame 12, or in part by the notch 66 and in part by a part of a drawer 14 or the frame 12, below and abutting against the bottom 18 of the open drawer 14.

Figure 2:
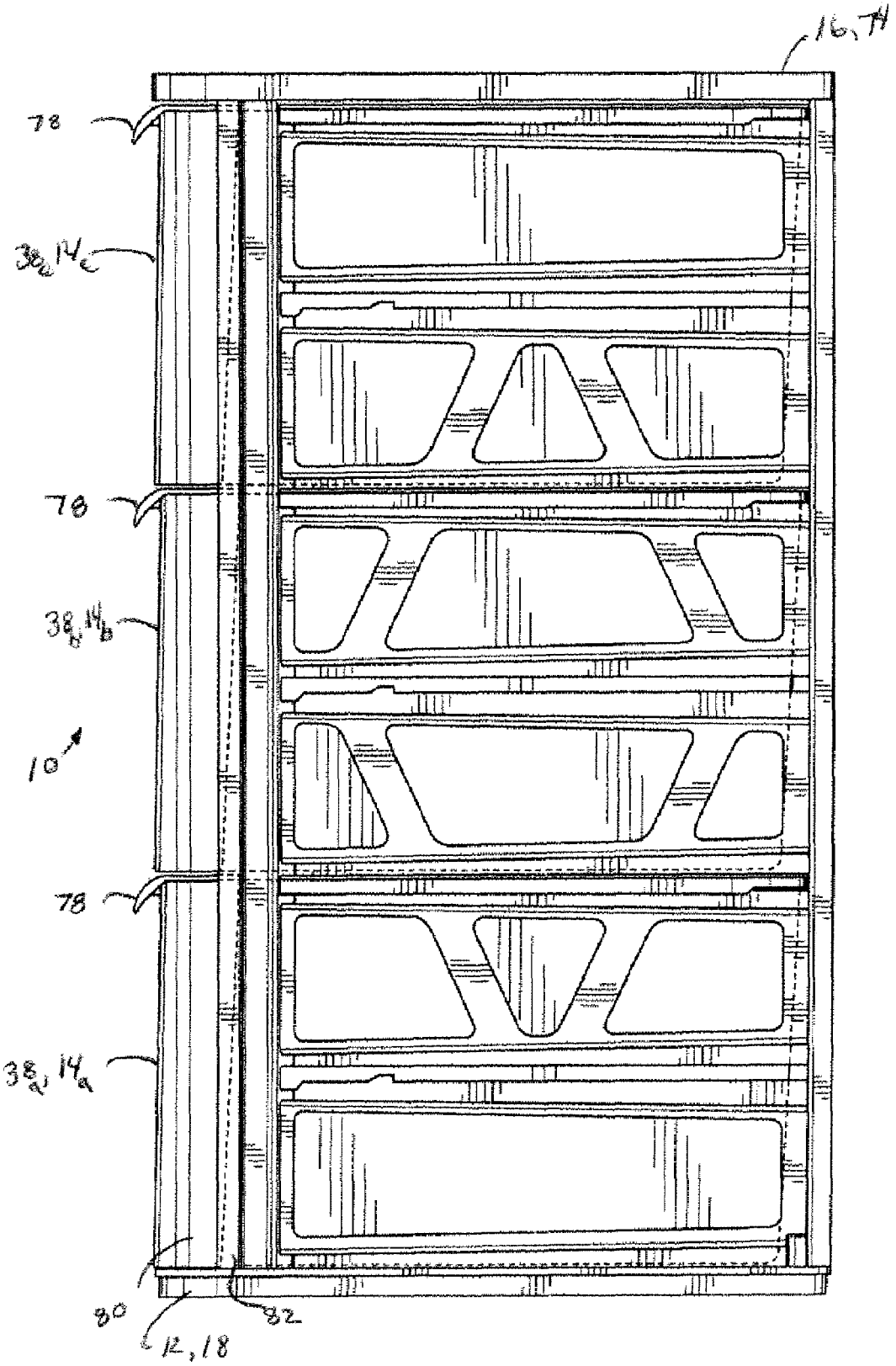
FIG. 2 is a right side elevation view of the drawer unit of FIG. 1.
Figure 10:
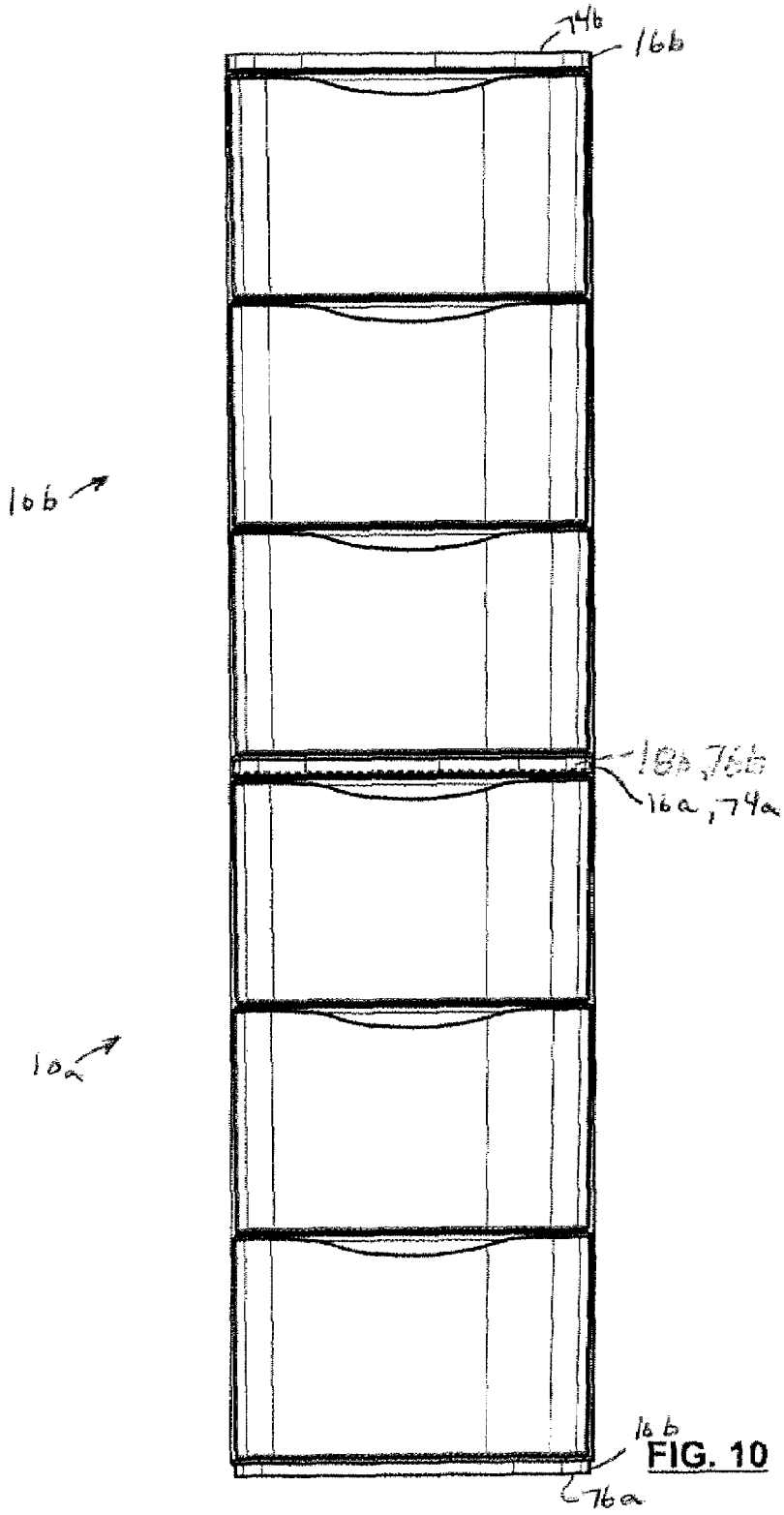
FIG. 10 is a front view of a pair of the drawer units of FIG. 1 stacked vertically.

Referring for example to FIGS. 1, 2 and 10, the top 16 of the frame 12 has a platform 72 surrounded by a raised lip 74. The bottom 18 of the frame 12 has a pedestal 76. The outer periphery of the pedestal 76 may be sized and configured to fit inside the lip 74 of the top 16. In this way, the bottom 18*b* of an upper drawer unit 10*b* can be fit inside the top 16*a* of a lower drawer unit 10*a*. The pedestal 76 may have an interference fit in the lip 74 such that the upper drawer unit 10*b* may not move sideways relative to the lower drawer unit 10*a*.

Referring for example to FIG. 2, the front 38 of the drawers 14 may slope upwards towards the back of the drawer 14. A front face of the front 38 of the drawer 14, excluding a handle 78, sticks out farther near the bottom 34 of the drawer 14 than near the top 28. In this way, a line of sight into a lower drawer 14 through a vertical gap between the lower drawer 14 and an upper drawer 14 only exists up to a shallow angle, for example 30 degrees or less or 20 degrees or less from horizontal. This makes it difficult to see the contents inside the lower drawer 14, even if the lower drawer 14 is slightly open, despite the lack or horizontal cross members between vertically adjacent drawer fronts 38. Since it is difficult to see into a lower drawer 14, the appearance of the front of the drawer unit 10 is smoother and less cluttered.

Referring, for example, to FIGS. 1, 2, 3A and 6, the front 38 of a drawer 14 may have edges 80 that extend beyond the sides 30, 32 of the drawer 14. As shown for example in FIG. 8C, these edges 80 hide the runners 46 and various other complex molded shapes of the sides 24, 26 of the frame 12 in a front view of the drawer unit 10. The edges 80 also hide the ridges 54 of the drawer 14 in a front view. This again provides a cleaner, less cluttered appearance to the front of the drawer unit 10.

In a side view, as shown for example in FIGS. 2 and 3A, the back of the edges 80 slope upwards and to the back of the drawer 14 at an angle from vertical slightly greater than for the face of the drawer 14 front 38. This provides draft angles to facilitate injection molding the drawers 14. However, when a drawer 14 is closed, the angle of the back of the edges 80 is hidden by a projection 82 of the sides 24, 26 or front 22 of the frame 12 that overlaps the edges 80 of the drawer 14. This again improves the appearance of the front of the drawer unit 10.

Figure 8A:
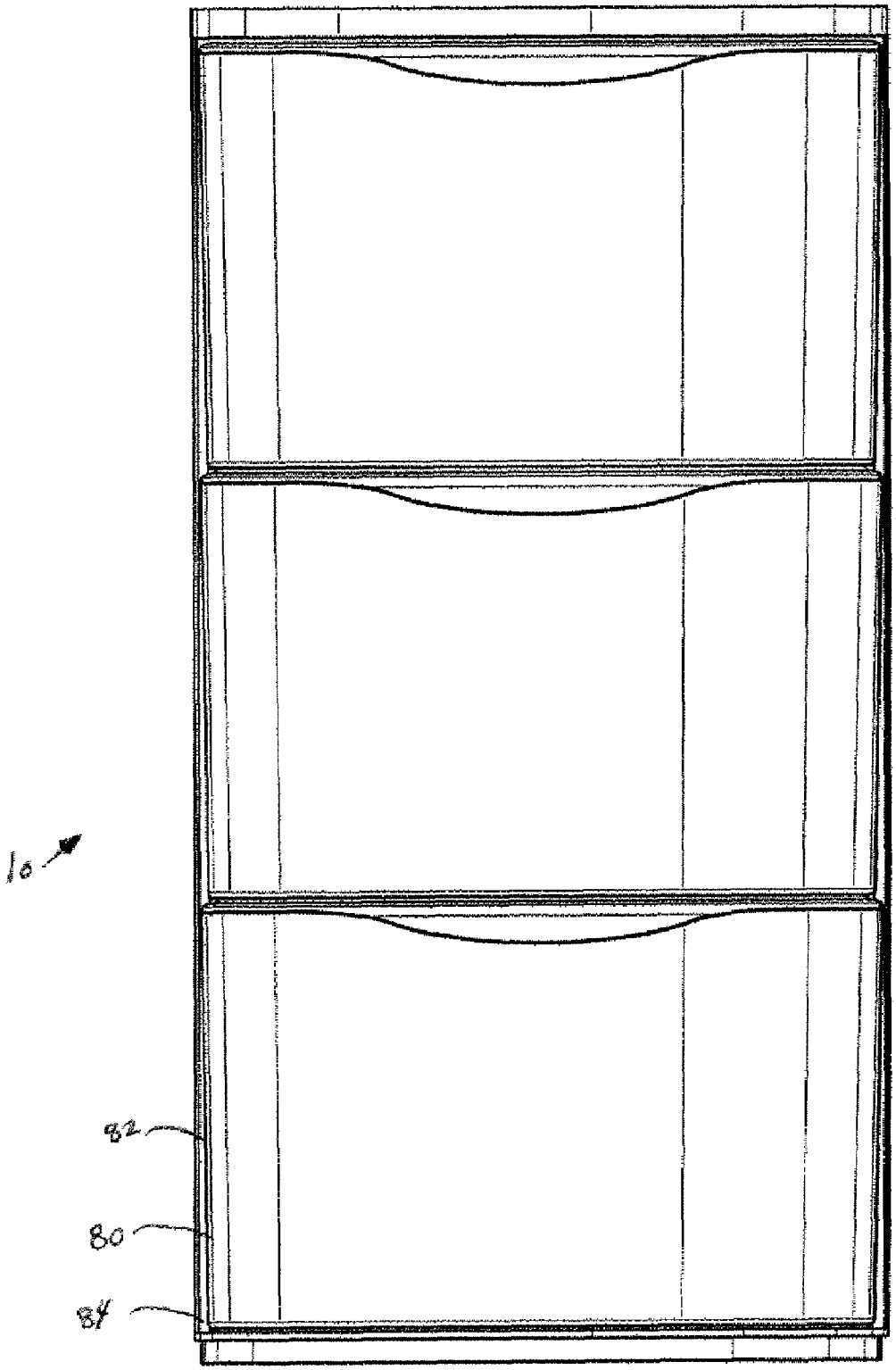
FIG. 8A is a front view of the drawer unit of FIG. 1.
Figure 8B:
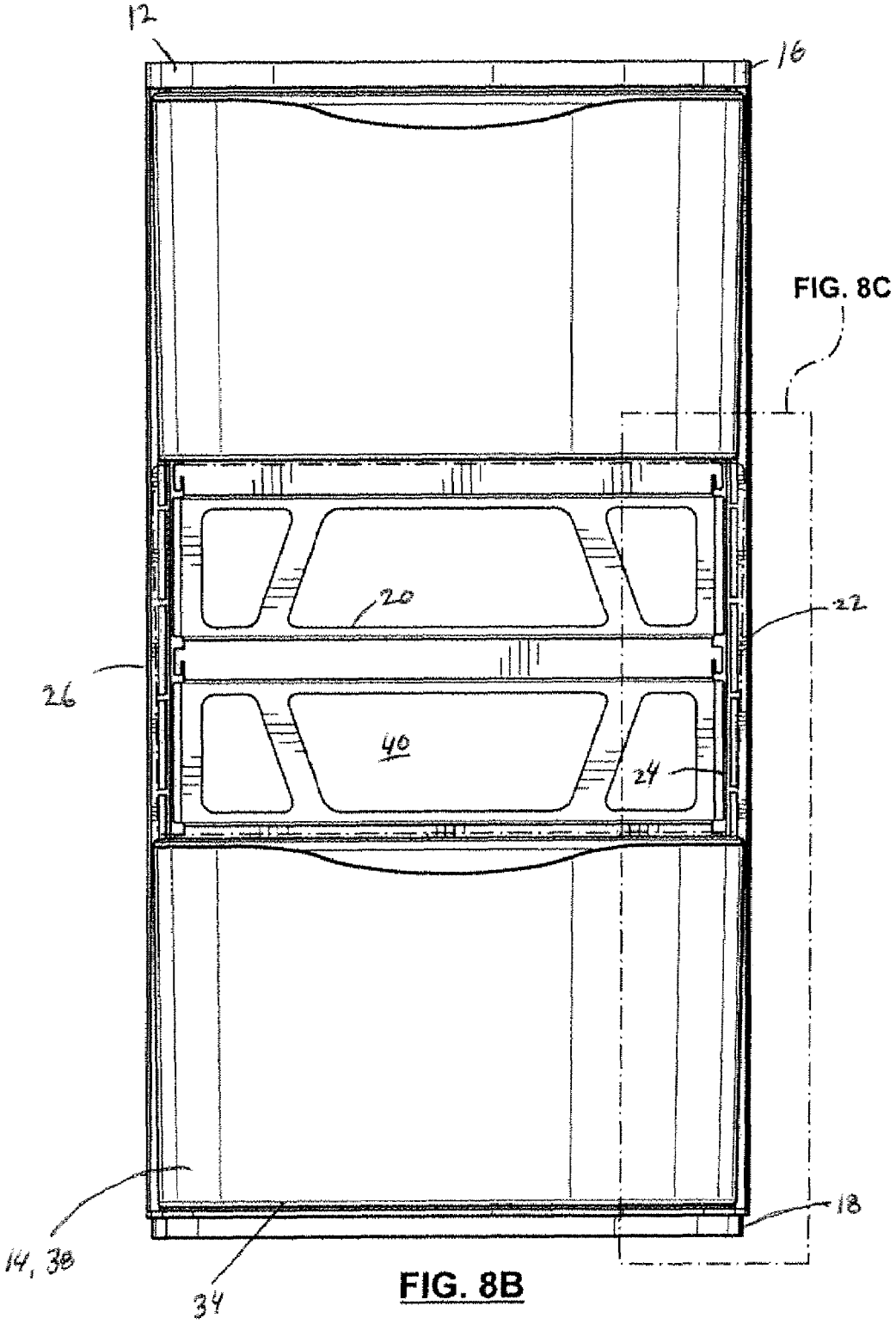
FIG. 8B is a front view of the drawer unit of FIG. 1 with a drawer removed.
Figure 8C:
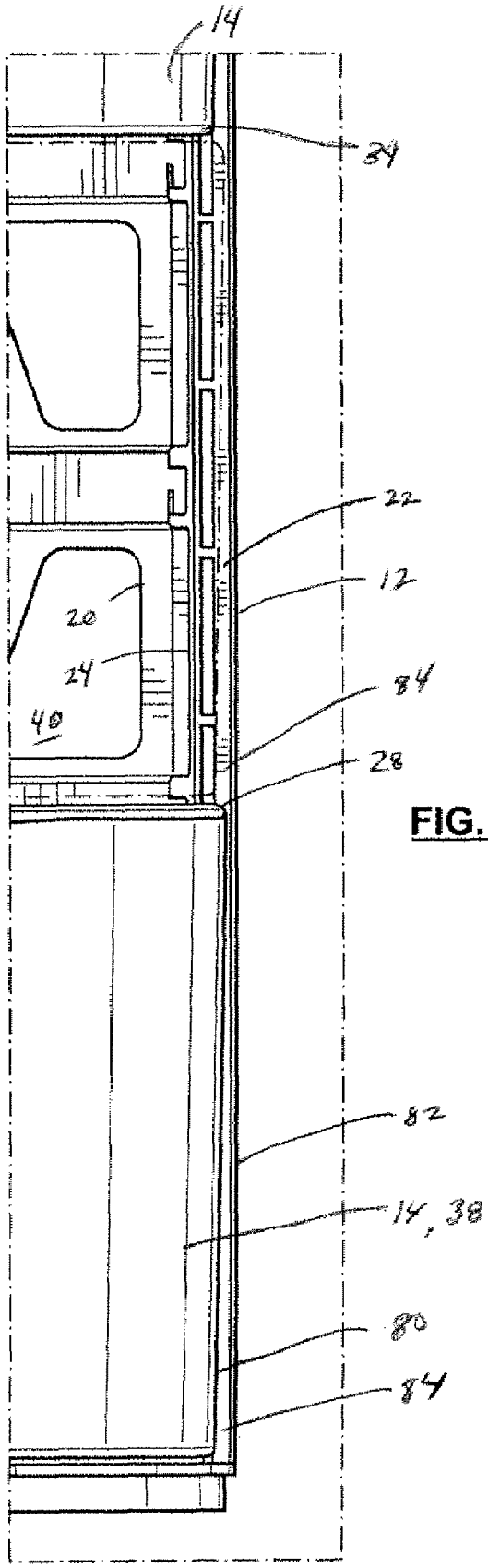
FIG. 8C is an enlarged view of a part of FIG. 8B.

As shown for example in FIGS. 8A, 8B and 8C, the edges 80 may also angle outwards towards the top 28 of the drawer 14. The drawer 14 may be generally wider at the top 28 than at the bottom 34. This again provides draft angles that facilitate injection molding the drawer. In a front view, spaces are created between the projection 82 and the edges. A smooth backing surface 84 of the sides 24, 26 or front 22 of the frame behind these spaces minimizes the visual distraction that might otherwise be created by those spaces.

The invention or inventions which are currently claimed in this document are described in the following claims.

I claim:

1. A drawer unit, comprising:

two or more drawers; and an injection molded frame molded as a single fully-formed piece having two sides, a top, and a bottom, and defining an opening sized for receiving the drawers, wherein parts of the drawers and frame form slider mechanisms supporting each drawer on the sides of the frame and allowing each drawer to slide between an open position and a closed position relative to the frame, each drawer having two sides, each side of each drawer having a ridge forming part of one of the slider mechanisms, the ridge comprising a generally horizontal portion extending outwards from the side of the drawer and an outer wall extending downwards from the generally horizontal portion, and the sides of the frame each having two or more runners, each of the two or more runners having a slot between an upper and a lower part of the runner forming another part of the one of the slider mechanisms;

wherein, on each side of the frame, the generally horizontal portion of one of the ridges of each drawer passes through the slot of one of the runners and the outer wall of the one of the ridges extends below the top of the lower part of the one of the runners such that a portion of the one of the runners is interior to the outer wall of the one of the ridges and provides a laterally interfering fit between the one of the ridges and the one of the runners so as to resist deflection of the sides of the frame away from each drawer;

wherein the two or more drawers include an upper drawer and a lower drawer, each drawer having a front that slopes upwards away from a bottom thereof and towards a back thereof such that when the upper drawer and the lower drawer are in a closed position, the bottom of the upper drawer protrudes forward beyond the top of the front of the lower drawer; and wherein the bottom of the upper drawer is supported by a top edge of the front of the lower drawer when the upper drawer is in an open position.

2. The drawer unit of claim 1, wherein the opening is open in plan view in an area containing the bottoms of the drawers and in elevation view between the top and bottom of the frame, and without cross-members spanning across the two sides of the frame between the top and the bottom of the frame.

3. The drawer unit of claim 1, wherein the slider mechanisms comprise a plurality of vertically spaced drawer slider rails molded into the sides of the frame.

4. The drawer unit of claim 3, wherein the depth of a drawer is larger than a spacing between at least two adjacent drawer slider rails.

5. The drawer unit of claim 1, wherein a front of each drawer extends horizontally past the sides of the drawer to define an edge of the front of the drawer, the edge configured to hide at least a portion of the frame.

6. The drawer unit of claim 5, wherein the backs of each edge slopes upwards away from the bottom of the drawer and towards the back of the drawer.

* * * * *